US010602890B2

(12) United States Patent
Billman et al.

(10) Patent No.: US 10,602,890 B2
(45) Date of Patent: Mar. 31, 2020

(54) DISPENSER FOR DISPENSING SHEET PRODUCTS

(71) Applicant: Essity Hygiene and Health Aktiebolag, Gothenburg (SE)

(72) Inventors: Craig Billman, Philadelphia, PA (US); Eric Kemner, Philadelphia, PA (US); Jason Zerweck, Philadelphia, PA (US); Rui Zhang, Philadelphia, PA (US); Kevin Murphy, Philadelphia, PA (US)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 0 days.

(21) Appl. No.: 16/474,195

(22) PCT Filed: Jan. 9, 2017

(86) PCT No.: PCT/EP2017/050360
§ 371 (c)(1),
(2) Date: Jun. 27, 2019

(87) PCT Pub. No.: WO2018/127303
PCT Pub. Date: Jul. 12, 2018

(65) Prior Publication Data
US 2019/0350417 A1 Nov. 21, 2019

(51) Int. Cl.
*A47K 10/44* (2006.01)
*A47K 10/42* (2006.01)
(Continued)

(52) U.S. Cl.
CPC ..... *A47K 10/422* (2013.01); *A47K 10/427* (2013.01); *A47K 10/424* (2013.01);
(Continued)

(58) Field of Classification Search
CPC .. A47K 10/422; A47K 10/427; A47K 10/421; A47K 2010/3246
See application file for complete search history.

(56) References Cited

U.S. PATENT DOCUMENTS 3,777,931 A 12/1973 Fleming
4,311,252 A 1/1982 Hope, Jr. et al.
(Continued)

FOREIGN PATENT DOCUMENTS

EP 0506243 A1 9/1992
EP 2309906 B1 4/2011
(Continued)

OTHER PUBLICATIONS

European Patent Office, International Search Report and Written Opinion of the International Searching Authority, International Application No. PCT/EP2017/050360, dated Sep. 27, 2017 (12 pages).

(Continued)

*Primary Examiner* — Gene O Crawford
*Assistant Examiner* — Ayodeji T Ojofeitimi
(74) *Attorney, Agent, or Firm* — Wood Herron & Evans LLP

(57) ABSTRACT

A dispenser for dispensing sheet products includes a housing configured to accommodate a stack of the sheet products and defines a dispensing opening, the housing having a housing body and a cover movably attached to the housing body so that the cover can be moved between an open refilling position and a closed use position, a support plate reciprocally movable within the housing body and having a support surface for supporting the stack of sheet products at one of opposite faces of the stack, a stop movable between an active position in which the stop cooperates with the support plate limiting the movability of the support plate within the
(Continued)

housing in one direction and an inactive position, and a link movably mounted in the housing body and cooperating with the cover and the stop to move the stop into the active position upon moving the cover into the open refilling position.

14 Claims, 3 Drawing Sheets

(51) Int. Cl.
*A47K 10/32* (2006.01)
*A47K 10/36* (2006.01)

(52) U.S. Cl.
CPC ..... *A47K 10/44* (2013.01); *A47K 2010/3233* (2013.01); *A47K 2010/3681* (2013.01)

(56) References Cited

U.S. PATENT DOCUMENTS

| | | | | |
|---|---|---|---|---|
| 4,717,043 | A | 1/1988 | Groover et al. | |
| 4,838,454 | A * | 6/1989 | Salzmann | A47K 10/427 221/279 |
| 4,938,382 | A | 7/1990 | Frazier et al. | |
| 4,953,747 | A * | 9/1990 | Wenkman | A47K 10/427 221/305 |
| 5,076,466 | A * | 12/1991 | Petterson | A47K 10/427 221/46 |
| 5,083,765 | A | 1/1992 | Kringel | |
| 6,257,443 | B1 * | 7/2001 | LaCount | A47K 10/427 221/35 |
| 2002/0033405 | A1 | 3/2002 | Gergek | |
| 2002/0074340 | A1 | 6/2002 | Phelps | |
| 2003/0019880 | A1 * | 1/2003 | Timmers | A47K 10/427 221/47 |
| 2007/0034638 | A1 * | 2/2007 | Zeiron | A47K 10/427 221/47 |
| 2008/0135570 | A1 | 6/2008 | Lee | |
| 2012/0318818 | A1 * | 12/2012 | Kobayashi | A47K 10/422 221/52 |
| 2013/0048667 | A1 * | 2/2013 | Wieser | A47K 10/421 221/283 |
| 2013/0221019 | A1 * | 8/2013 | Rozek | A47K 10/427 221/36 |
| 2014/0319164 | A1 * | 10/2014 | Wilson | A47K 10/422 221/45 |
| 2014/0326745 | A1 * | 11/2014 | Young | A47K 10/422 221/45 |
| 2015/0090832 | A1 | 4/2015 | Case et al. | |
| 2016/0090229 | A1 * | 3/2016 | Stenberg | B65D 83/0894 221/1 |
| 2016/0374524 | A1 * | 12/2016 | Stenberg | A47K 10/422 221/59 |

FOREIGN PATENT DOCUMENTS

| | | | |
|---|---|---|---|
| EP | 2751002 | B1 | 11/2016 |
| WO | 2006071148 | A1 | 7/2006 |
| WO | 2010042675 | A1 | 4/2010 |
| WO | 2014154282 | A1 | 10/2014 |
| WO | 2015163802 | A1 | 10/2015 |

OTHER PUBLICATIONS

The Russian Federal Service for Intellectual Property, Office Action, Application No. 2019125202/12(049262), dated Dec. 16, 2019 (7 pages).

The Russian Federal Service for Intellectual Property, Office Action, Application No. 2019121432, dated Dec. 26, 2019 (7 pages).

* cited by examiner

DISPENSER FOR DISPENSING SHEET PRODUCTS

CROSS-REFERENCE TO RELATED APPLICATION

The present application is a national stage entry under 35 U.S.C. § 371 of, and claims priority to, International Application No. PCT/EP2017/050360, filed Jan. 9, 2017, the disclosure of which is hereby incorporated herein by reference in its entirety.

FIELD OF THE INVENTION

The present invention relates to a dispenser configured to contain and dispense sheet products, particularly sanitary paper sheet products such as hand towels, paper napkins, facials, toilet paper or other wiping products in sheet form.

BACKGROUND OF THE INVENTION

Sheet products are generally stacked and accommodated in a housing of the dispenser. The individual sheet products may be folded. Comfortable dispensing of the folded sheet products from the dispenser is enabled by interfolding consecutive sheet products. Thus, when a folded sheet product is pulled out through a dispensing opening of the dispenser, the immediate next (consecutive) folded sheet product is also subject to a pulling force making the immediate next folded sheet product partially protrude from the dispensing opening and being partially unfolded. Thus, this protruding part is easily accessible and can be gripped by a user.

One problem with dispensers of this kind is that they can be overloaded or overfilled with sheet products. This can result in a high pressure against the stack of sheet products increasing the friction between the individual sheet products of the stack and the leading sheet product to be dispensed through the dispensing opening and the dispenser.

In manual dispensers, in which a sheet product is dispensed by manually gripping and withdrawing a sheet product through the dispensing opening, such increased friction may make it difficult to remove the sheet product from the dispenser. In the worst case, the sheet product may tear during withdrawal. As regards interfolded stacks, the increased friction may also prevent the next folded sheet product from partially protruding from the dispensing opening as described above. Hence, it becomes difficult to withdraw the next sheet product. In either case, there is a certain risk that the user withdraws more sheet products from the dispenser than necessary.

Considering automatic dispensers, comprising a dispensing mechanism actuated by the user to automatically dispense a specific number of sheet products, the increased friction may impair the operation and reliability of the dispensing mechanism in that no sheet product or the wrong number of sheet products is dispensed. Also, in this case damaging, particularly ripping and tearing of the sheet products, cannot be excluded.

In view of the above, there is a need to prevent overfilling or overloading of such dispensers. One such mechanism is implemented in the manual dispenser disclosed in US 2002/0074340 A1.

Another mechanism is disclosed in EP 0 506 243 A1.

SUMMARY OF THE INVENTION

It is desired to provide a mechanism for reliably preventing or at least reducing the risk of high pressure exerted on the sheet products within the dispenser due to overfilling or overloading the dispenser, which is applicable substantially independent from the configuration of the dispenser and particularly the movement of the cover and is easy to use.

According to one aspect of the present invention, a dispenser for dispensing sheet products is suggested.

The dispenser may be a manual dispenser in which the sheet products are dispensed by a manual pulling force. Alternatively, the dispenser may be an automatic dispenser including a dispensing mechanism configured to dispense a specific number (one or more) of sheet products at a time. The dispensing mechanism may be mechanically or electrically triggered.

The dispenser can be particularly configured for dispensing sanitary paper products in sheet form. Examples of sanitary paper products are hand towels, paper napkins, facials, toilet paper or other wiping products in sheet form. The sheet products may be made of tissue paper (ISO 12625-1) or nonwoven (ISO 9092).

The dispenser can be further configured to accommodate a plurality of sheet products in the form of a stack. Thus, the dispenser may have a longitudinal extension in the direction of stacking. Within the stack, the sheet products may be interfolded, wherein any interfolding technique may be implemented, such as but not limited to those described in EP 2 309 906 B1 or EP 2 751 002 B1. In this context, interfolding is to be understood in that at least one panel of a first sheet product is sandwiched between two panels of a second sheet product adjacent to the first sheet product in the stack and one panel of a third sheet product is sandwiched between two panels of the second sheet product, the third sheet product being adjacent to the second sheet product in the stack, and so on. As described earlier, the benefit of interfolding is when a leading folded sheet product is pulled out through a dispensing opening of the dispenser, the immediate next (consecutive) folded sheet product is also subject to a pulling force making the immediate next folded sheet product partially protrude from the dispensing opening and being partially unfolded. A plurality of stacks of interfolded sheet products may be contained in the dispenser, wherein the sheet products at an interface between two consecutive stacks are not interfolded, which is often referred to as a bundle break.

The suggested dispenser includes a housing to accommodate the stack of the sheet products, the housing defining a dispensing opening. The housing of the dispenser may have a support surface or a pedestal configured to place the housing on a horizontal surface. Alternatively, the housing may be configured for mounting on a vertical wall or post. Furthermore, the dispensing opening may be directed in any suitable direction when the housing is in use including a downward, an upward, a forward or any intermediate direction. The housing includes a housing body and a cover. The cover is movably attached to the housing body, so that the cover can be moved between an open refilling position and a closed use position in order to enable refilling of the dispenser with one or more stacks (bundles) of sheet products. In this context, the cover may be rotatably and/or translationally movable between the two positions. According to one aspect, the cover is, however, rotatable about an axis of rotation.

According to an example, the dispensing opening is defined in the cover. As a result, the dispensing opening moves together with the cover when the cover is moved to the open refilling position or the closed use position. In other examples, however, the dispensing opening may also be part of the housing body.

Furthermore, the dispenser has a support plate reciprocally movable within the housing and having a support surface for supporting the stack of sheet products at one of opposite faces of the stack. According to a particular aspect, the support plate and its support surface are arranged so as to support that face of the stack of sheet products facing away from the dispensing opening (the last sheet of the stack). Further, the support plate may be positioned distanced from the axis of rotation of the cover, when the dispenser is filled with sheet products. Even further, the direction of movement of the support plate may be perpendicular to the axis of rotation of the cover.

The support plate may be urged in a direction toward the dispensing opening in order to continuously feed the sheet products to the dispensing opening. This may be achieved by implementing an elastic member, such as a spring, operatable between the support plate and the housing body and tensioned in the direction of the dispensing opening when the dispenser is filled with sheet products. In one particular example, a torsion spring may be employed. For example, a first end of the sheet like torsion spring may be attached to the housing body and a second opposite end of the torsion spring may be attached to a rotatable axis mounted to the support plate. The torsion spring tends to coil and is extended (uncoiled) upon movement of the support plate away from the dispensing opening during filling of the dispenser with one or more stacks of sheet products. Upon dispensing of the sheet products, the stack decreases and the torsion spring continuously coils accompanied by a rotation of the axis thereby moving the support plate towards the dispensing opening. Yet, other elastic members may as well be used, such as a tension spring.

The suggested dispenser further includes an overfilling or overloading prevention mechanism. It is to be understood that the term "overfilling or overloading prevention mechanism" does not necessarily prevent overfilling at the time of refilling but prevents high pressure to be exerted on the stack of sheet products after the refilling has been completed. The overfilling or overloading prevention mechanism includes a stop inhibiting a (further) movement of the support plate during refilling and a link configured to operate the stop, wherein the link is operated by the movement of the cover.

In particular, the stop is movable between an active position in which the stop cooperates with the support plate limiting the movability of the support plate within the housing in one direction and an inactive position. The one direction may be a direction away from the dispensing opening and may be the only direction in which movement of the support plate is inhibited.

Further, the link is movably mounted in the housing body and cooperates with the cover and the stop to move the stop into the active position upon moving the cover into the open refilling position. Thereby, an automatic operation of the stop upon opening of the cover is realized making the refilling process easy for the user. Further the link enables adaption of the overfilling prevention mechanism to any kind of dispenser independent of the attachment of the cover to the housing body. Thus, the overfilling prevention mechanism of the present disclosure is readily adaptable to a plurality of different dispensers still being purely mechanical and hence cost-effective. In particular, a link, which can be produced as relatively inexpensive plastic molding part, is relatively inexpensive as compared to an electric solution incorporating a switch and a driving mechanism. Furthermore, many of those dispensers are standalone devices without power connection. Thus, an electric solution is either not possible or would implement batteries. In the latter case, the power budget would be limited. In particular in dispensers in which the power is also needed for other functions, such as with automatic dispensers for driving the dispensing mechanism, the purely mechanical solution of the present disclosure is preferred because it is not stressing the power budget.

So as to provide a fairly simple mechanism, the link may be urged in a direction away from the stop. This again may be realized by providing an elastic member cooperating with the link. In particular, a spring may be used which is at one of opposite ends supported by the link and at the other of the opposite ends support relative to the housing body. In a particular example, a compression spring may be used as the elastic member acting between the link and the housing body. Yet, also other elastic members are conceivable such as a tension spring or a torsion spring. In one example, the link may be moved away from the stop upon movement of the cover into the open refilling position by extension (or compressing) of the spring, whereas the link is moved toward the stop upon movement of the cover into the closed use position thereby compressing (or by extension of) the spring.

According to one aspect, the link may be translationally movable relative to the housing body. The translational movement may, for example, be parallel to the translational movement of the support plate. If an elastic member is implemented to urge the link in one direction, the elastic member may induce the force in one direction, whereas closing of the cover pushes the link in the opposite direction. Thus, a simple and reliable mechanism can be realized. Yet, it is also possible to employ a link that is rotatably or translationally/rotatably supported in the housing body.

According to an aspect, the link is not physically connected to the cover. Rather, the link is moved by mere contact with the cover upon moving the cover into the closed use position. As previously indicated, this may be employed in combination with urging the link relative to the housing body in a direction towards the cover. Accordingly, once the cover is opened (moved to the open refilling position), the link is automatically moved due to its urging. In this state, the link protrudes from the housing body. After refilling the dispenser, the cover is again closed (moved to the closed use position), wherein the cover comes into contact with the protruding link and upon further closing pushes the link back into the housing body against the urging force.

In order to achieve a relatively low friction contact between the link and particularly the protruding portion thereof and the cover, particularly a surface of the cover facing the link, the contact surface of the link may be curved. In one embodiment, the cover may be rotatably attached to the housing body about an axis of rotation perpendicular to the translational movement of the link. In this particular embodiment, it may be preferred that the contact surface is curved from a point furthest away from the axis of rotation to a point closest to the axis of rotation of the cover. The point furthest away from the axis of rotation is, hence, protruding furthest from the housing body and the protruding height gradually decreases from this point toward the point closest to the axis of rotation of the cover.

In a particular embodiment, the stop is urged into the active position. This again may be achieved by employing an elastic member, particularly a spring. The spring may be a tension spring. Yet, a compression spring is as well conceivable. Accordingly, the stop will, depending on the used spring, by extension or compression be automatically moved into the active position limiting the movement of the support plate. If a tension spring is used, the stop may include a hook hooking one of opposite ends of the tension spring, wherein another hook is fixed relative to the housing body hooking the other of the opposite ends of the tension spring.

According to an aspect, the link and the stop may be decoupled. In other words, it may be that the link and the stop are not physically connected but cooperate by mere contact. Particularly, a front face of the link cooperates (is contactable/abutable) with a counter surface of the stop. Such configuration simplifies the assembly process of the dispenser, because the link and the stop may separately be mounted within the housing body. Nevertheless, it is also conceivable to physically connect the link and the stop by a joint. In this case, it would in principle be also sufficient to either urge the link in one direction as described above or the stop as described above.

In one aspect, the stop is rotatable about an axis of rotation between the active and the inactive position. To put it differently, the stop is rotatably supported relative to the housing body. If a translationally movable link is used (see above), the translational movement may be translated into a rotational movement enabling that the stop acts in a different direction than the movement of the link. In one particular example mentioned above, the link is translationally movable parallel to the movement of the support plate. Yet, in order to limit this movement of the support plate, a stop has to be moved into the movement path of the support plate. Due to the stop being rotatably supported, the movement of the link parallel to the movement of the support plate may be translated into a movement "perpendicular" thereto, whereby the stop is moved into the movement path of the support plate to assume its active position. This provides for a very simple and effective solution with only a small number of parts to translate the movement without the necessity to provide complicated transmissions and joints.

In a particular example, the stop includes a lever arm on one side of the axis of rotation and configured to cooperate with the link and a stop member on the opposite side of the axis of rotation and configured to cooperate with the support plate for limiting the movement of the support plate in the active position of the stop. As explained above, the stop and the link may cooperate by mere contact. In this context, for movement of the stop, the counter surface of the stop is part of the lever arm coming into contact with the contact surface of the link in order to rotate the stop about the axis of rotation. The stop member on the opposite side of the axis of rotation is thereby rotated into the movement path of the support plate for limiting its movement.

According to an aspect, the stop may have a projection for limiting the movement of the stop. If, for example, the stop is urged into the active position, as explained above and the stop and link are not connected to each other (freely contactable) as also explained above, this projection may ensure that the stop always remains in a position in which the front face of the link and a counter surface of the stop are aligned relative to each other so as to enable a contact thereof for movement of the stop. If a rotatable stop is employed, the projection may, for example, prevent over-rotation of the stop into a position in which the front face of the link would pass by the counter surface of the stop leading to a malfunction of the system. According to one example, the projection is located on the stop member.

According to an aspect, the support plate has a guide member translationally guided along a guide of the housing body, wherein the stop in the active position of the stop cooperates with the guide member to limit the movement of the support plate. The guide member may be T-shaped in cross-section extending through a longitudinal opening of the guide and catching behind the edges of the opening. According to this aspect, the stop engages with the guide member, which is very effective use of the available assembly space. In particular, the housing body is primarily configured to accommodate the sheet products. Yet, the support plate has to be guided within the housing body along the stack of sheet products. Thus, assembly space is needed for the guide of the support plate anyway. Using this assembly space to also incorporate the stop and the remainder of the overfilling prevention mechanism is effective use of the available space.

As previously described, the link is operated by the opening/closing movement of the cover. Thereby, the link can receive a double function. In particular, because the link is operated by the opening/closing movement of the cover, the link may also be used to detect whether the cover is opened/closed. Accordingly, a switch may be provided which is fixed relative to the housing body, wherein the switch is operated by the movement of the link upon moving the cover into the open refilling position. Thus, the dispenser can recognize when the cover is opened. This may particularly be beneficial if an automatic dispenser is employed in order to prevent that the dispensing mechanism is activated with the cover being in the open refilling position, whereby misuse can be prevented. Also, manual dispensers may benefit from such a solution. For example, the dispenser may be incorporated into a computer network to indicate a filling state to a central location. In this instance, an open cover may be noticed to the central location as well.

According to an example, the switch may be a mechanical switch having a manually movable actuating tab to operate the switch. In this example, the link may have a cam surface acting on the tab upon movement of the link so that the actuating tab is moved and operates the switch. Yet, also other solutions such as optical sensors, magnetic sensors, etc. may be used to conclude on the open/close to state of the cover on the basis of the movement or position of the link.

Further aspects of the present disclosure may be found in the following description of a particular embodiment making reference to the accompanying drawings.

DETAILED DESCRIPTION OF THE INVENTION

Figure 1:
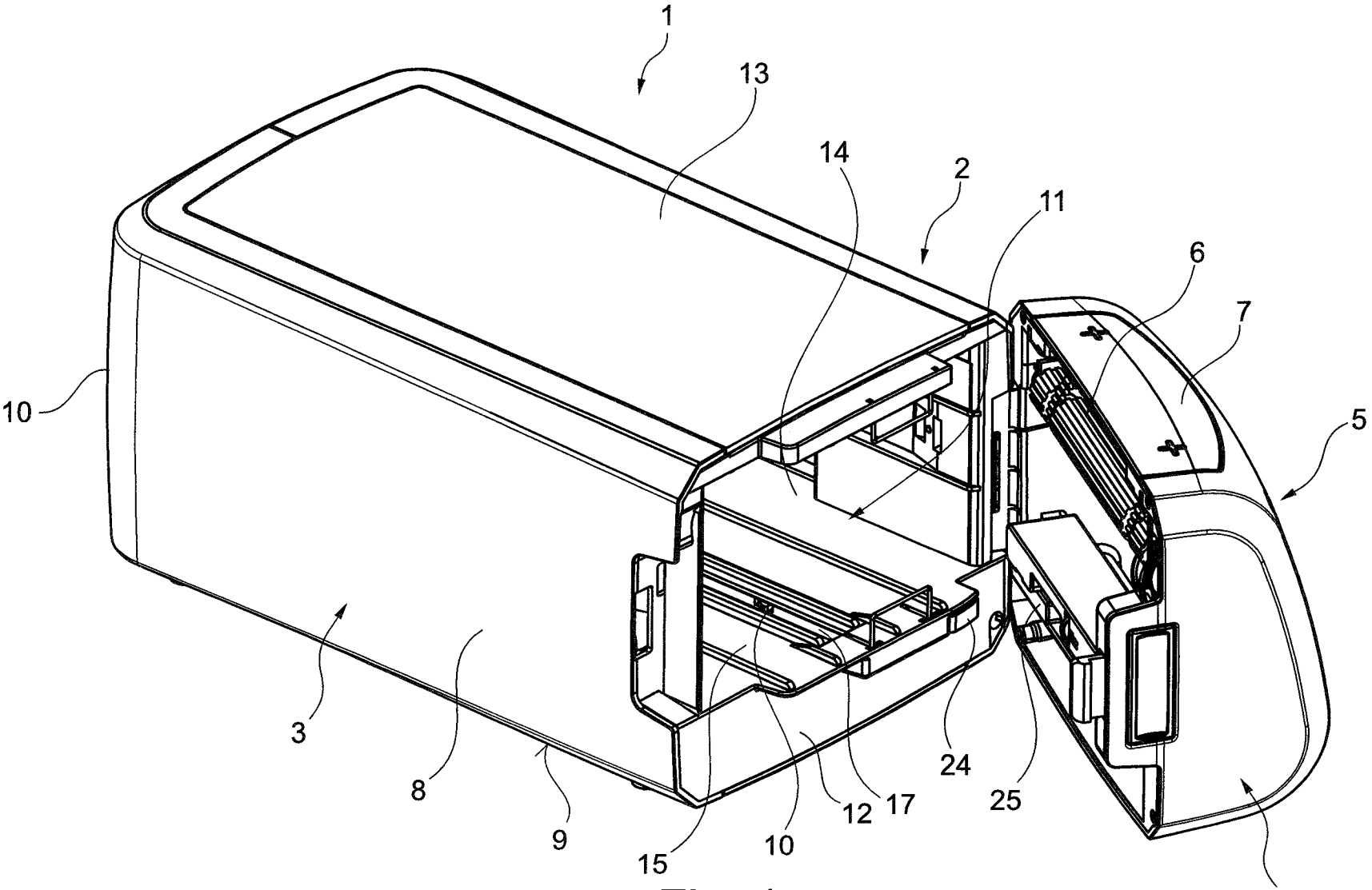
FIG. 1 shows a perspective view of a dispenser according to an embodiment.

Throughout the drawings, the same reference numerals have been used for the same elements.

A particular embodiment of a dispenser 1 is described as an example with reference to FIGS. 1 to 5.

The dispenser 1 includes a housing 2 having a housing body 3 and a cover 4 (the cover may also be referred to as a door). A dispensing opening 5 is provided at the front of the cover 4. The dispenser 1 is configured for being placed on a horizontal surface as shown in FIG. 1 and with the dispensing opening 5 directed forward. Yet, also other orientations of the dispenser 1 are conceivable such as with the dispensing opening 5 being directed downward or upward. A dispenser 1 having a downwardly oriented dispensing opening is, for example, known from WO 2014/154282 A1.

The cover 4 is hinged to the housing body 3 so as to be rotatable about a vertical axis. This has been proven advantageous for refilling the dispenser and the implementation of an automatic dispensing mechanism 6 incorporated into the cover 4. Yet, it is also conceivable that the cover 4 is rotatable about a horizontal axis or to attach the cover so as to be translationally and rotatably movable. In any case, the cover 4 is fixed to the housing body 3 so as to be movable between a closed use position in which the dispenser 1 is ready for dispensing sheet products and an open refilling position (shown in FIG. 1) allowing refilling of the dispenser 1. In the present embodiment, the cover 4 is rotated about the vertical axis for moving the cover 4 between the two positions.

As previously described, a dispensing mechanism 6 is incorporated into the cover 4. The dispensing mechanism 6 is driven by an electric motor for dispensing one or more sheet products at a time. The dispensing mechanism 6 may be triggered by a bottom 7 located on the cover 4. Yet, also other triggering mechanisms known in the art are possible. Further, the overfilling prevention mechanism described in the following is also applicable to pure manual dispensers in which one sheet product at a time is dispensed by being manually pulled out of the dispensing opening 5.

The housing body 3 of the housing 2 defines a compartment 14 for accommodating a stack of sheet products. The housing body 3 has opposite side walls 8, a bottom 9, a back wall 10 and a refilling opening 11 defined in a front wall 12. The cover 4 is hinged to the front wall 12 and configured to cover the refilling opening 11 in the closed use position and to give access to the refilling opening 11 in the open refilling position. Further, the housing body 3 has a removable top 13 which may be removed for easier access to the compartment 14 for refilling.

The compartment 14 is delimited at its lower side by a bottom plate 15 on which a lower edge of the sheet products may rest. Further, two parallel longitudinal guides 16 are provided which extend between the front wall 12 and the back wall 10. A longitudinal opening 17 is provided between the two parallel guides 16.

A support plate 18 (see FIGS. 2 to 5) is provided within the compartment 14. The support plate 18 has a support surface 19 for supporting a back face of the stack of sheet products (a last sheet product in the stack of sheet products contained in the dispenser 1). The support plate 18 is translationally movable along the guides 16. For this purpose, the support plate has a guide member 20 (see FIGS. 2, 4 and 5). The guide member 20 extends through the longitudinal opening 17 between the guides 16 and catches behind the guides 16. In a particular example as shown in the drawings, the guide member 20 is T-shaped in cross section (see FIG. 5), the "T" being inverted. The vertical leg of the "T" extends through the opening 17, whereas the horizontal legs of the "T" catch behind the opposite guides 16.

The support plate 18 is urged toward the refilling opening 11 and hence the dispensing opening 5 of the shown dispenser 1. Accordingly, the support surface 19 of the support plate 18 pushes the stack of sheet products toward the dispensing opening 5. According to an example, this may be achieved by torsion springs 21 on either side of the support plate 18 as seen perpendicular to the direction of movement of the support plate 18. The torsion springs 21 tend to coil about a rotatable axis 22. One end of the longitudinal and sheet shaped torsion springs 21 is attached relative to the housing body 3, whereas the opposite end thereof is attached to the rotatable axis 22. Upon dispensing the sheet products from the dispenser 1, the support plate 18 is pushed by the springs 21 towards the front, wherein the springs 21 coil about the thereby rotating axis 22. Yet, also other mechanisms are conceivable such as a tension spring fixed at one end relative to the support plate 18 and at the other end relative to the housing body 3.

During refilling of the dispenser it may happen, as described in the introductory portion, that too many sheet products are filled into the compartment 14. As a consequence, the pressure between the front face of the stack of sheet products (the first or leading sheet product in the stack of sheet products) may become rather high upon closing of the cover 4. Accordingly, there is a certain risk that the dispensing mechanism 6 cannot properly operate dispensing the wrong number of sheet products or even no sheet product. If a manual dispenser without a dispensing mechanism 6 is employed, problems may occur to the user when withdrawing one sheet product at a time which may lead to too many sheet products being dispensed. In either case, there is a high likelihood that sheet products will be damaged during dispensing. To counteract these disadvantages an overfilling prevention mechanism is suggested, which is described in the following.

The overfilling prevention mechanism includes a link 23 and a stop 29 operated by the link 23.

The link 23 is a rigid and longitudinal bar. Further, the link 23 is translationally guided within the housing body 3. In particular, the link 23 is reciprocally movable in parallel to the longitudinal extension of the guides 16 and the longitudinal opening 17. A front end of the link 23 extends through an opening in the front wall 12 of the housing body 3 and protrudes therefrom as shown in FIG. 1. The front end of the link 23 has a contact surface 24 for cooperation with a counter surface 25 of the cover 4 facing the front wall 12 of the housing body 3. The contact surface 24 is curved whereas the counter surface 25 is planar. In particular, the contact surface 24 slopes in a top or bottom view from a most distanced position relative to the front wall 12 towards the front wall 12 in a direction of the axis of rotation of the cover 4. This is best visible from the FIGS. 2B and 3B. Consequently, a low friction contact can be realized between the contact surface 24 and the counter surface 25 when closing the cover 4.

Furthermore, a compression spring 26 is provided to urge the link toward the cover 4. The compression spring 26 is at one end supported by a shoulder 27 of the link 23 and at the opposite end at a not shown support fixed relative to the housing body 3. Accordingly, the link 3 is pushed by the compression spring 26 away from the back wall 10 in the direction of the cover 4 or the front wall 12. As a result, the link 23 is automatically moved forward when opening the cover 4.

Figure 4:
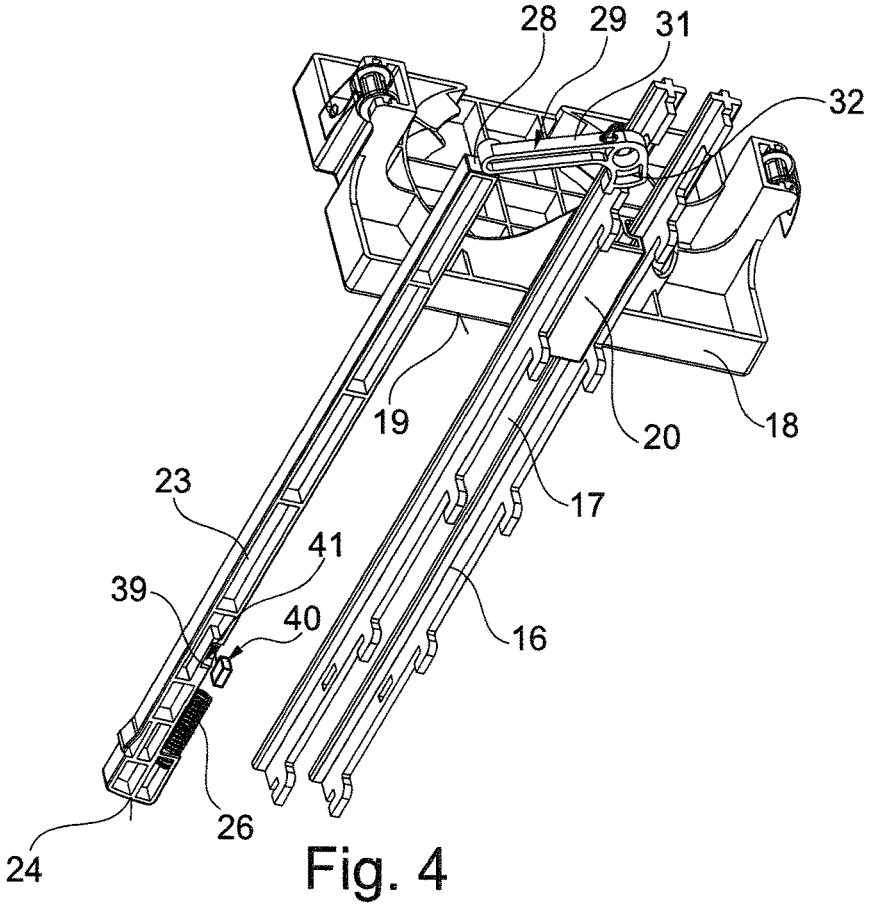
FIG. 4 shows a perspective bottom view of the overfilling mechanism of FIG. 1.
Figure 5:
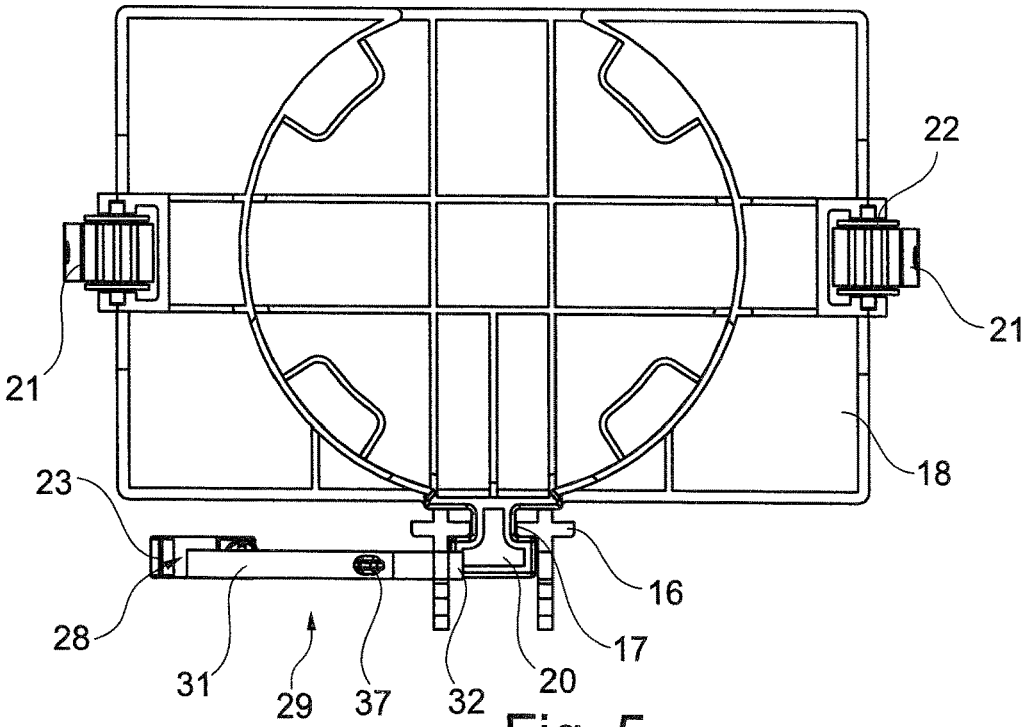
FIG. 5 shows a back view of the overfilling mechanism of FIG. 1.

Moreover the link 23 has, as shown in FIG. 4, a cam surface 39 and a return surface 41 in its lower surface. The cam surface 39 is formed by an inclined surface delimiting a recess in the lower surface of the link 23. The return surface 41 is formed by a wall delimiting the recess opposite to the cam surface 39 in a direction of movement of the link 23. Upon movement of the link 23, the cam surface 39/return surface 41 engages with a mechanical switch 40 fixed relative to the housing body 3 whereby the mechanical switch is switched. Thus, a control of the dispenser 1 may conclude on opening of the cover 4 and the link 23 provides for a double function (overfilling prevention and cover sensor).

Moreover, the link 23 has a front face 28 at an end opposite to the contact surface 24. This front face 28 is configured for cooperation with the stop 29.

Figure 2A:
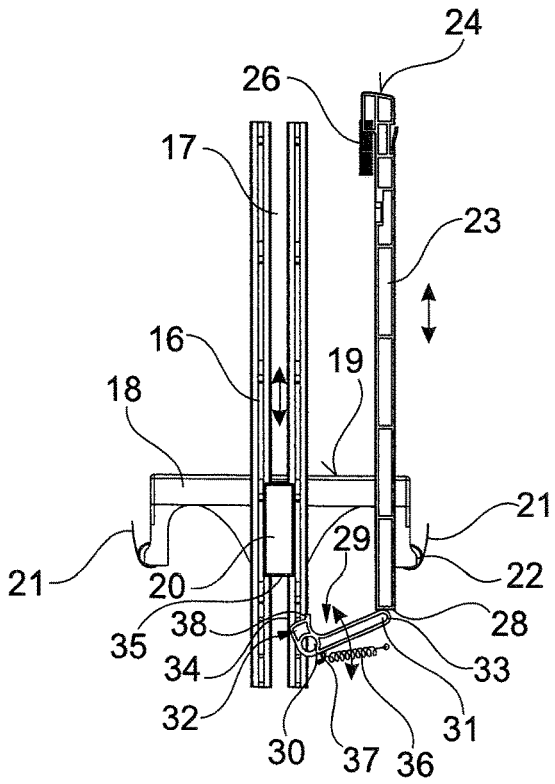
FIGS. 2A and 2B show bottom views of the dispenser of FIG. 1 with several parts being removed to reveal the overfilling mechanism, wherein FIG. 2B still shows the side walls and the cover of the casing, whereas these parts have been removed in FIG. 2A.
Figure 2B:
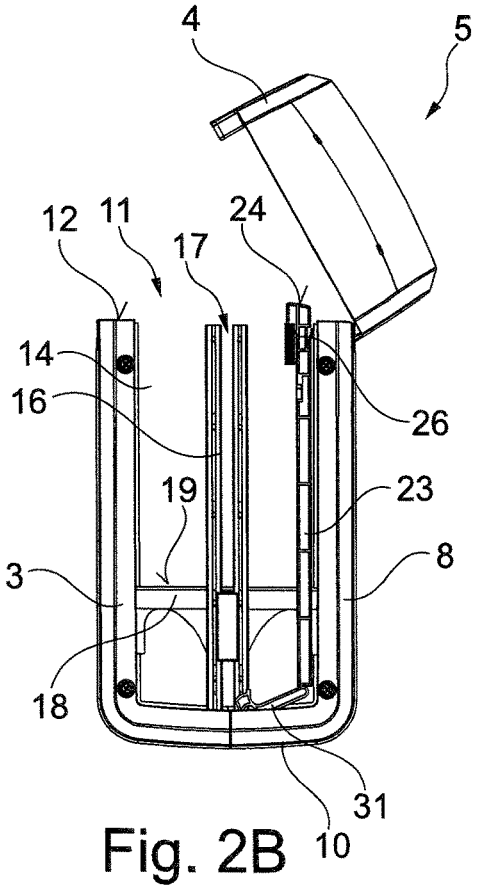
Figure 3A:
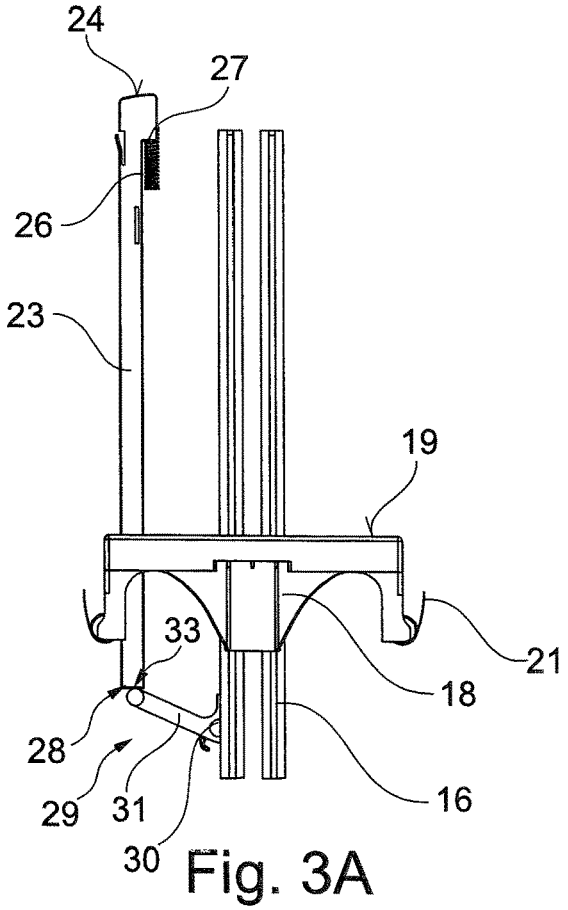
FIGS. 3A and 3B show top views of the dispenser of FIG. 1 with several parts being removed to reveal the overfilling mechanism, wherein FIG. 3B still shows the side walls and the cover of the casing, whereas these parts have been removed in FIG. 3A.
Figure 3B:
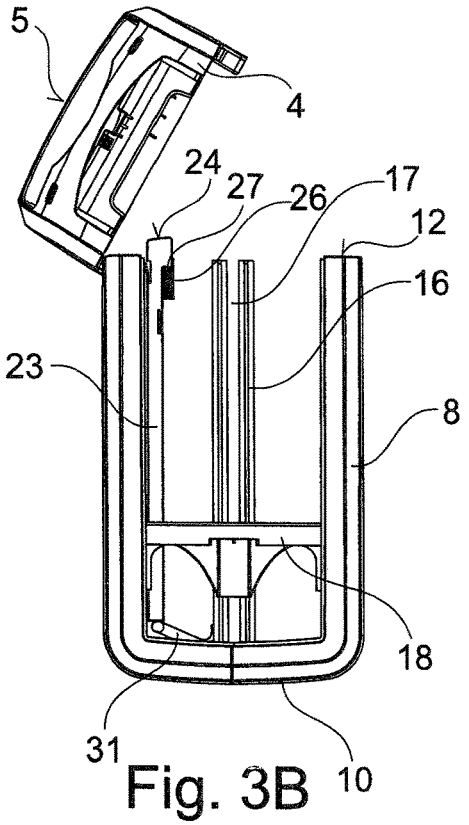

The stop 29 is in the example rotatably supported relative to the housing body 3 about an axis of rotation 30 (best seen in FIG. 2A). The stop 29 as a lever arm 31 on one side of the axis of rotation 30 and a stop member 32 on the opposite side of the axis of rotation 30.

The lever arm 31 has at its end opposite to the axis of rotation 30 a counter surface 33 for the corporation with the front face 28 of the link 23. The stop 29 and the link 23 are not physically connected but only contact each other at the front face 28 and the counter surface 33. Yet, in other embodiments, the link 23 and the stop 29 may be physically connected by a joint.

The stop member 32 has at its end opposite to the axis of rotation 30 a stop surface 34. The stop surface 34 may engage with a counter stop surface 35 of the guide member 20 of the support plate 18 as will be explained later.

The stop is urged by a tension spring 36 (schematically indicated in FIG. 2A) about the axis of rotation in a counterclockwise direction. For this purpose, the tension spring 36 is attached at one end at an integrally formed hook 37 and at the opposite end relative to the housing body 3.

In order to prevent over-rotation of the stop 29 about the axis of rotation of 30, a projection 38 is provided at the stop member 32, i.e., close to the stop surface 34. The projection 38 comes into engagement with a side surface of one of the guides 16 thereby preventing a further rotation of the stop member 29 about the axis 30.

In the following, the function of the overfilling prevention mechanism is explained.

Once the dispenser 1 requires refilling, a user moves the cover 4 to the open refilling position shown in FIG. 1. Due to the urging force of the compression spring 26, the link 23 moves forward (in a direction from the back wall 10 to the front wall 12). Thereby, the return surface 41 engages with and switches the switch 40. As a result, the control recognizes that the cover 4 is in the open refilling position and may, for example, disable the dispensing mechanism 6.

Because of the movement, the front face 28 of the link 23 moves away from the stop 29 (upward in FIG. 2A). Due to the spring force of the tension spring 36, the stop 29 is rotated about the axis of rotation 30 in a counterclockwise direction. Thereby, the stop member 32, and particularly the stop surface 34, are moved into the movement path of the guide member 20. A further rotation in this state is prevented by the engagement of the projection 38 with one of the guides 16 (the right-hand guide 16 in FIG. 2A).

This state is shown in the drawings and may be referred to as overfilling prevention state. When a user now refills the dispenser with sheet products introduced through the opening 11 and/or the top when the top wall 13 is removed, the support plate 18 will be pushed toward the back wall 10 against the spring force of the torsion springs 21. In this overfilling prevention state, the support plate 18 may only be moved toward the back wall 10 until engagement of the counter stop surface 35 of the guide member 20 with the stop surface 34 of the stop member 32 of the stop 29. In this state, the compartment 14 has a first volume.

If the user feels that enough sheet products have been placed in the dispenser, the cover 4 will be closed and, hence, be rotated (moved) into the closed use position. During this process, the counter surface 25 engages with the contact surface 24, whereby the link 28 is pushed towards the back wall 10 against the spring force of the compression spring 26. Due to the contact between the front face 28 and the counter surface 33, the movement of the link 23 acting on the lever arm 31, the stop 29 is rotated about the axis of rotation 30 in a clockwise direction against the spring force of the tension spring 36. As a result, the stop member 32 and particularly the stop surface 34 are rotated out of the movement path of the guide member 20. As a result, further movement of the support plate 18 to increase the first volume of the compartment 14 to a second volume larger than the first volume is enabled. As a consequence, any pressure which may have occurred due to overfilling of sheet products into the compartment 14 during the overfilling prevention state may be relieved by a further movement of the support plate 18 towards the back wall 10 increasing the volume of the compartment. Consequently, the overfilling prevention mechanism of the present disclosure reliably avoids any risk of a too high pressure between the leading sheet products and/or the leading sheet product and a cover 4. Accordingly, problems when dispensing the sheet products from the dispenser 1 may be avoided or at least be reduced. To use this mechanism, the user merely needs to open the cover 4 so that the mechanism is easy and reliably to use.

Further and upon closing of the cover 4, the cam surface 39 of the link 23 again engages with and switches the switch 40 so that the control can conclude that the cover 4 has been closed and again enable the dispensing mechanism 6.

If one opens the cover 4 in this state, the link 23 cooperating with the switch 40 may still be used to conclude on an open position of the cover. If the stack of sheet products occupies the portion of the second volume used to relieve the pressure as described above, the support plate 18 has passed by the stop 29 and the stop 29 is prevented from rotating into the movement path of the support plate 18 by the guide member 20 (the stop member 32 abuts at a side surface of the guide member 20 and thereby rotation of the stop 29 is prevented). Because the link 23 and the stop 29 are not physically connected (attached to each other) the link 23 still moves forward, the return surface 41 acts on and switches the switch 40, whereby the open position of the cover 4 may be detected.

It is to be understood that the above-described embodiment is a mere example and various modifications are conceivable. As previously described, the dispenser can also be oriented differently with the dispensing opening 5 directed upward or downward. It could as well be a wall-mounted dispenser.

Also, the cover 4 may be rotatably attached to the housing body 3 about a horizontal axis of rotation. According to an alternative embodiment, the cover 4 may also be attached to be rotatably and translationally movable relative to the housing body 3 in order to bring the cover 4 into the open refilling position and the closed use position.

Even further, various different urging mechanisms for urging the separate elements such as the link 23, the stop 29 and the support plate 18 in a specific direction can be implemented instead of the used springs 21, 26 and 36.

Furthermore, the embodiment has been described with respect to an automatic dispenser having a dispensing mechanism 6 driven by an electric motor. Yet, the present disclosure may also be implemented in manual dispensers in which the dispensing mechanism 6 is manually driven (for example, by actuating a lever) or even fully manual dispensers in which the sheet products are dispensed by gripping and pulling the sheet products manually.

Thus, the present disclosure is not limited to the above embodiment but various modifications and alterations are conceivable within the scope of the appended claims.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A dispenser for dispensing sheet products, comprising:

a housing configured to accommodate a stack of the sheet products, the housing defining a dispensing opening and comprising a housing body and a cover movably attached to the housing body so that the cover can be moved between an open refilling position and a closed use position;

a support plate reciprocally movable within the housing body and having a support surface for supporting the stack of sheet products at one of opposite faces of the stack;

a stop movable between an active position in which the stop cooperates with the support plate limiting the movability of the support plate within the housing in one direction and an inactive position; and a link movably mounted in the housing body and cooperating with the cover and the stop to move the stop into the active position upon moving the cover into the open refilling position.

2. The dispenser according to claim 1, further comprising a switch fixed relative to the housing body, wherein the switch is operated by the movement of the link upon moving the cover into the open refilling position.

3. The dispenser according to claim 1, wherein the support plate has a guide member translationally guided along a guide fixed relative to the housing body, wherein the stop in the active position of the stop cooperates with the guide member to limit the movement of the support plate.

4. The dispenser according to claim 1, wherein the stop has a projection for limiting the movement of the stop.

5. The dispenser according to claim 1, wherein the stop and link cooperate by contact of a front face of the link with a counter surface of the stop.

6. The dispenser according to anyone claim 1, wherein the stop is urged into the active position.

7. The dispenser according to preceding claim 1, wherein the link is translationally movable.

8. The dispenser according to claim 1, wherein the link is urged in a direction away from the stop.

9. The dispenser according to claim 1, wherein the support plate is urged in a direction toward the dispensing opening.

10. The dispenser according to claim 1, wherein the dispensing opening is defined in the cover.

11. The dispenser according to claim 1, wherein the link is moved by contact with the cover upon moving the cover into the closed use position.

12. The dispenser according to claim 11, wherein a contact surface of the link facing the cover is curved.

13. The dispenser according to claim 1, wherein the stop is rotatable about an axis of rotation between the active and inactive position.

14. The dispenser according to claim 13, wherein the stop comprises a lever arm on one side of the axis rotation and configured to cooperate with the link and a stop member on the opposite side of the axis of rotation and configured to cooperate with the support plate for limiting the movement of the support plate in the active position of the stop.

* * * * *